US005120036A

United States Patent [19]

Simons

[11] Patent Number: 5,120,036

[45] Date of Patent: Jun. 9, 1992

[54] PRESS STITCHER TRANSFER MECHANISM

[75] Inventor: Randal N. Simons, Glen Ellyn, Ill.

[73] Assignee: R. R. Donnelley & Sons Company, Chicago, Ill.

[21] Appl. No.: 727,401

[22] Filed: Jul. 9, 1991

[51] Int. Cl.[5] ..... B42B 2/00

[52] U.S. Cl. ..... 270/53; 270/54; 270/55; 270/58

[58] Field of Search ..... 270/53, 54, 55, 57, 270/58; 198/644

[56] References Cited

U.S. PATENT DOCUMENTS

| | | | |
|---|---|---|---|
| 1,644,192 | 10/1927 | Kast . | |
| 3,057,620 | 10/1962 | McCain . | |
| 3,317,026 | 5/1967 | Zugel | 270/54 |
| 3,362,304 | 1/1968 | Skolnick . | |
| 3,366,225 | 1/1968 | Thorp | 270/54 |
| 3,492,955 | 2/1970 | Gallagher | 270/54 |
| 3,601,388 | 8/1971 | Hilliard | 270/54 |
| 3,613,217 | 10/1971 | Perkins . | |
| 4,236,706 | 12/1980 | Schlough . | |
| 4,478,398 | 10/1984 | Stobb . | |
| 4,479,642 | 10/1984 | Macey . | |
| 4,489,930 | 12/1984 | Meier . | |
| 4,519,599 | 5/1985 | Mayer | 270/53 |
| 4,522,383 | 6/1985 | Macey . | |
| 4,533,132 | 8/1985 | Wangermann | 270/53 |
| 4,555,101 | 11/1985 | Stobb . | |
| 4,614,290 | 9/1986 | Boss | 270/53 |
| 4,641,825 | 2/1987 | Mowry et al. . | |
| 4,650,174 | 3/1987 | Stobb . | |

*Primary Examiner*—Edward K. Look
*Assistant Examiner*—Therese M. Newholm
*Attorney, Agent, or Firm*—Wood, Phillips, Van Santen, Hoffman & Ertel

[57] ABSTRACT

A folded signature transfer and press stitcher delivery mechanism for receiving folded signatures draped over a signature conveying system, delivering the folded signatures to a press stitcher and returning the folded, stitched signatures to the signature conveying system includes an elongated first, inclined plow cooperatively associated with the gathering chain for slidably receiving folded signatures therefrom. The continuous propeller is adapted to push the folded signatures along the first inclined plow. A carriage is cooperatively associated with the first inclined plow for slidably receiving folded signatures therefrom. The carriage is disposed intermediate a pair of lateral offset continuous drive systems. A dual belt conveyor drive drives the continuous drive systems in the same direction at substantially the same velocity. The carriage is connected to the continuous drive systems such that it is driven in a preselected unchanging orientation about a closed path defined by the continuous drive systems. A press stitcher is disposed along the closed path of the carriage for stitching the signature carried by the carriage. A second inclined plow is disposed upon the closed path of the carriage downstream from the first plow and the press stitcher for slidably receiving the folded, stitched signatures from the carriage.

33 Claims, 4 Drawing Sheets

PRESS STITCHER TRANSFER MECHANISM

BACKGROUND OF THE INVENTION

1. Technical Field

The present invention is directed towards a press stitcher transfer mechanism and, more particularly, towards a mechanism for conveying properly aligned folded signatures to a press stitcher.

2. Background Art

Mechanisms or conveyors for collecting and transporting signatures to a stitcher are well known in the art. Typically, these mechanisms are intended for use with a conventional reciprocating stitcher assembly, but the use of such stitcher assemblies has numerous drawbacks. For example, reciprocating stitcher assemblies are usually the limiting factor in the effort to quickly process signatures into completed products In addition, reciprocating stitcher assemblies have many moving parts causing them to break down relatively frequently, further limiting the ability to quickly process signatures. Illustrative of mechanisms for feeding signatures into a conventional reciprocating stitcher are those discussed in Macey U.S. Pat. No. 4,479,642 and Mowry et al. U.S. Pat. No. 4,641,825.

A significant increase in the speed at which signatures are processed may be achieved by using a rotary press stitcher. The use of a rotary press stitcher requires that the spine or fold of the signature be aligned perpendicular to the line of travel of the conveyor. Thus, if a rotary stitcher is to be used, the signature conveyor shown in Macey is unacceptable.

Stob U.S. Pat. No. 4,478,398 discloses a press stitcher conveyor which delivers signatures to a rotary press stitcher with the spine or fold aligned perpendicular to the direction of travel. Stob's press stitcher conveyor does, however, presents several serious drawbacks. For instance, Stob teaches the stitcher transport mechanism as being disposed vertically, but due to space constraints, the Stob configuration may be impractical for many installations. Stob also requires a shoe or guide to force the signatures to be pivoted 90° into proper alignment for stitching. As will be apparent, this pivot step can jostle the stacked signatures under transport which could result in misaligned stitched signatures.

The present invention is directed toward overcoming one or more of the problems discussed above.

SUMMARY OF THE INVENTION

An object of the present invention is to provide a press stitcher delivery mechanism for conveying properly oriented and aligned folded signatures to a rotary press stitcher for stitching the signatures together.

An additional object of the invention is to provide a press stitcher delivery mechanism that will allow for increased speed in stitching signatures to thereby accelerate the speed at which the signatures may be processed.

A further object of the invention is to provide a press stitcher delivery mechanism that maintains folded signatures in the same orientation while routing them from the gathering chain to the press stitcher and back to the gathering chain so as to minimize disruption of the stitcher assembly and associated bindery line.

In one aspect of the present invention, a press stitcher delivering mechanism for conveying properly aligned and folded signatures to a press stitcher comprises first and second continuous drive systems. The second continuous drive system is disposed in a plane parallel and subjacent to the plane formed by the first continuous drive system. In addition, the press stitcher delivering mechanism is arranged such that the second continuous drive system is laterally offset from the first continuous drive system.

With this arrangement, a dual belt conveyor drive propels the first and second continuous drive systems in the same direction at substantially the same speed. A carriage for carrying a signature is disposed between the first and second continuous drive systems and is connected thereto such that the first and second continuous drive systems drive the carriage in a closed path defined thereby, and the carriage is maintained in a preselected, unchanging orientation as it is driven about the closed path by a structure interconnecting the carriage to the first and second continuous drive systems. Still additionally, the press stitcher delivering mechanism includes a press stitcher disposed at an advantageous location along a closed path about which the carriage is driven for stitching the signature carried thereon.

In a second aspect of the present invention, a signature transfer mechanism for receiving folded signatures draped over a signature conveying system is disclosed. An elongated inclined plow is cooperatively associated with the signature conveying system for slidably receiving folded signatures therefrom. A continuous propelling means disposed adjacent to the inclined plow pushes the folded signatures along the inclined plow. With this arrangement, a controller maintains the continuous propelling means at a speed substantially the same as or greater than the speed of the signature conveying system.

In a third aspect of the present invention, a folded signature transfer and press stitcher delivery mechanism for receiving folded signatures from a signature conveying system, delivering the folded signatures to a press stitcher and returning the folded and stitched signatures to the signature conveying system is presented and disclosed herein. A first elongated inclined plow is cooperatively associated with the gathering chain for slidably receiving folded signatures therefrom. A first continuous propelling means is disposed adjacent to the first inclined plow and is adapted to push the folded signatures along the first inclined plow. Still additionally, a controller is provided such that the first continuous propelling means travels at substantially the same or a greater speed than the signature conveying system and a carriage is cooperatively associated with the first plow for slidably receiving folded signatures therefrom.

As for the carriage, it is disposed intermediate a first and second continuous drive systems with the second continuous drive system being disposed in a plane parallel and subjacent to the plane formed by the first continuous drive system and the second continuous drive system being laterally offset from the first continuous drive system. A dual belt conveyor drive serves to drive both of the first and second continuous drive systems in the same direction at substantially the same speed, that speed being substantially the same as or greater than the speed of the first continuous propelling means. With this arrangement, the carriage is connected to the first and second continuous drive systems such that it is driven in a preselected unchanging orientation about a closed path defined by the first and second continuous drive systems.

As for additional details of this aspect of the invention, a press stitcher is disposed along the closed path of the carriage for stitching the signature carried by the carriage. A second inclined plow is disposed along the closed path of the carriage downstream from the first plow and the press stitcher for slidably receiving the folded, stitched signatures from the carriage where a second continuous propelling means is disposed adjacent to the second inclined plow. Still further, a controller maintains the speed of the second continuous propelling means at a speed substantially the same as or greater than the speed of the first and second continuous drive systems.

In yet another aspect of the present invention, a method for stitching folded signatures from a signature conveying system is provided. The folded signatures from the signature conveying system are transferred to a first elongated inclined plow which is cooperatively associated with the signature conveying system for slidably receiving folded signatures therefrom. The folded signatures are propelled along the inclined plow at a speed substantially the same as or greater than the speed of the signature conveying system. The folded signatures are then slidably transferred to a carriage which is driven about a continuous closed path in a preselected unchanging orientation. A releasable clamping mechanism may be used to releasably clamp the signatures to the carriage. The folded signatures are stitched using a rotary press stitcher disposed along the continuous closed path of the carriage downstream from the first elongated inclined plow. The folded, stitched signatures are then unclamped from the carriage and transferred to a second inclined plow disposed along the path of the carriage downstream from the rotary press stitcher where they are propelled along the second inclined plow at a speed substantially the same as or greater than the speed of the carriage. Thereafter, the folded stitched signatures are transferred back to the signature conveying system from the second inclined plow.

Still other aspects, objects and advantages of the present invention can be obtained from a study of the specification, the drawings, and the appended claims.

DETAILED DESCRIPTION OF THE PREFERRED EMBODIMENT

Figure 1:
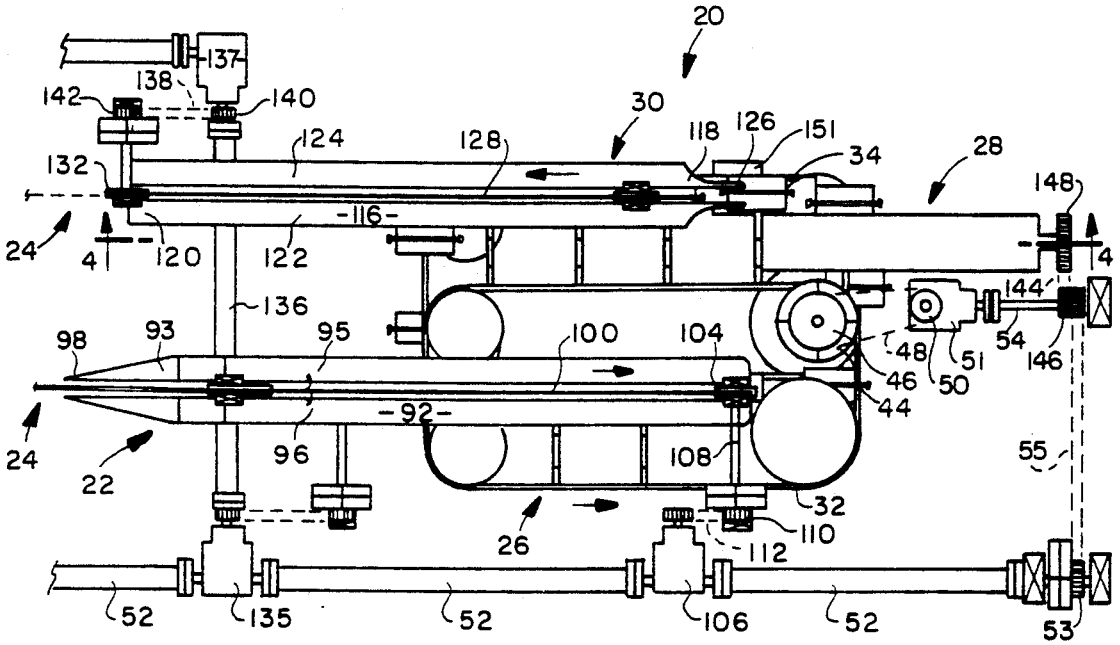
FIG. 1 is a top plan view of a folded signature transfer and press stitcher delivery mechanism according to the present invention.

Referring to FIG. 1, the folded signature transfer and press stitcher mechanism 20 comprises a signature transfer mechanism 22 cooperatively associated with upstream and downstream portions of a gathering chain or signature conveying system 24 carrying folded, unstitched signatures. The signature transfer mechanism 22 is in turn cooperatively associated with a press stitcher delivery mechanism 26 which receives unstitched signatures therefrom. The press stitcher delivery mechanism 26 conveys the folded, unstitched signatures received from the signature transfer mechanism 22 to a rotary press stitcher 28 where they are stitched. The press stitcher delivery mechanism 26 is in turn cooperatively associated with a signature removal mechanism 30 which receives folded, stitched signatures therefrom. Finally, the signature removal mechanism 30 is cooperatively associated with a continuation of the gathering chain or signature conveying system 24 so as to transfer folded, stitched signatures thereto.

Figure 2:
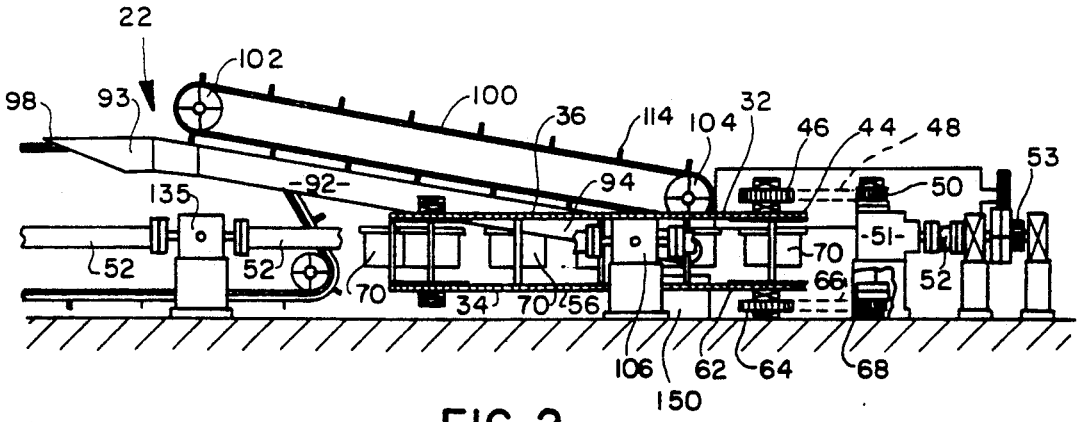
FIG. 2 is a side elevational view of the folded signature transfer and press stitcher delivery mechanism of FIG. 1.
Figure 3:
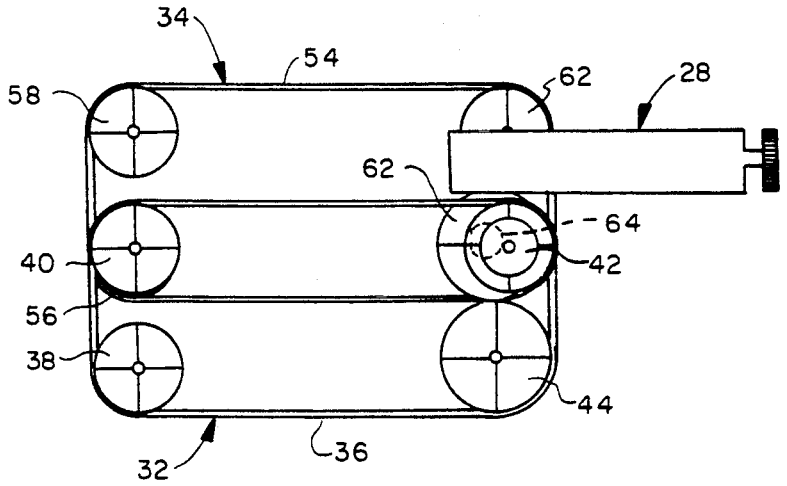
FIG. 3 is a top plan view of the press stitcher delivery mechanism portion of the present invention.

The press stitcher delivery mechanism 26 comprises a first continuous drive system 32 and a second continuous drive system 34. As illustrated in FIG. 2, the second continuous drive system 34 is disposed subjacent to the first continuous drive system 32. Referring to FIG. 3, it can also be seen that the first continuous drive system 32 is laterally offset from the second continuous drive system 34. Further, as shown in FIG. 3, the first and second continuous drive systems 32 and 34 define essentially identical configurations.

Still, referring FIG. 3, the first continuous drive system 32 comprises a continuous belt conveyor 36 having a generally rectangular configuration defined by three sprocketed idler wheels 38, 40 and 42 which engage and direct the continuous belt conveyor 36. A first sprocketed driving wheel 44 is disposed in the remaining corner of the generally rectangular configuration of the continuous belt conveyor 36. As best seen in FIGS. 1 and 2, the first sprocketed driving wheel 44 is concentrically connected to a power sprocket wheel 46 which is engaged and driven through a power belt 48 by means of a sprocketed drive shaft 50 operatively interconnected to the gear box 51. A line main drive 52 has a sprocket 53 operatively connected to the gear box 51 through the shaft 54 extending from gear box 51 by the belt 55. The line main drive 52 drives and controls the entire press stitcher mechanism 20 at a synchronized speed.

Referring to FIGS. 2 and 3, the second continuous drive system 34 also comprises a continuous belt conveyor 56 in a generally rectangular configuration. A set of three sprocketed idler wheels 57, 58 and 60 engage and guide the continuous belt conveyor 56 and are disposed in three of the four corners of the generally rectangular configuration. A second sprocketed driving wheel 62 engages and drives the continuous belt conveyor 56 in the corner not occupied by the sprocketed idler wheels 57, 58 and 60 through a power sprocket wheel 64 concentrically attached thereto. As best seen in FIG. 2, a power belt 66 engages and drives the power sprocket wheel 64 through a sprocketed drive shaft 68 of the press stitcher operatively interconnected to the gear box 51. As described above, a line main drive 52 is operatively connected to the gear box 51 for controlling and driving the second belt conveyer 56.

Referring to FIG. 2, a plurality of carriages 70 are disposed intermediate the first continuous drive system 32 and the second continuous drive system 34. It will be seen in FIG. 6 that the carriages 70 have a profile generally resembling an inverted "V". At the top of the carriage is an anvil 71 forming the apex of the inverted "V". A clamp 72 for releasably clamping a signature carried on the carriage 70 has first and second clamp arms 73, 74 which are pivotly mounted at the ends of the inverted "V" by pivotal connectors 75, 76, preferable hinges. A spring 77 normally biases the clamp 72 such that its arms 73, 74 clamp against the legs of the inverted "V". Attached to the bottoms of the clamp arms 73, 74 are cam followers 78,79. A rod 80 extends downwardly from the first carriage 70. At the distal end 81 of the rod 80 is a belt pin fixture or pivotal connection 82. It will also be seen that a rod 84 extends upwardly and away from the clamp 70. As will be will be appreciated from FIG. 7, the rod 84 has a belt pin fixture or pivotal connection 86 connected to its distal end 87.

Figure 6:
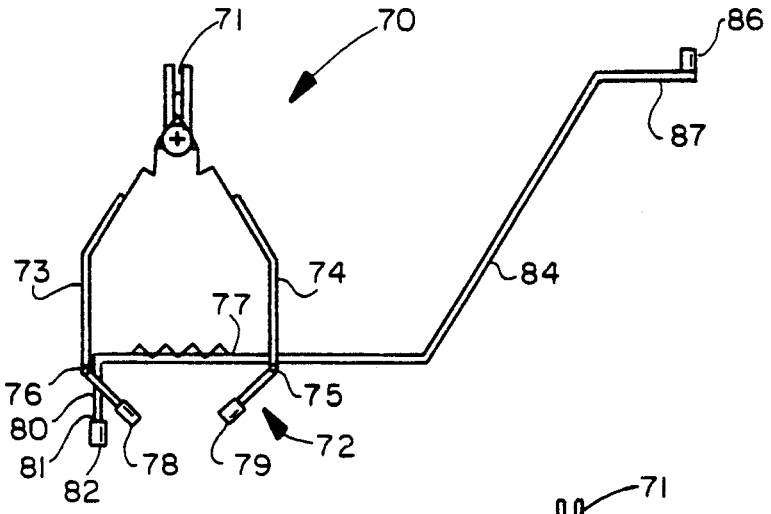
FIG. 6 is a front elevational view of a carriage portion of the present invention.
Figure 8:
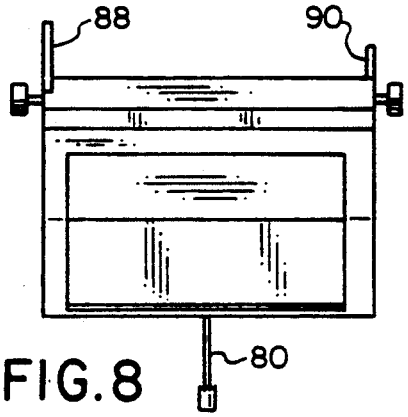
FIG. 8 is a side elevational view of the carriage portion of the present invention shown in FIG. 6.

Referring to FIGS. 2 and 6, the carriages 70 are adapted to be disposed intermediate the first and second continuous drive systems 32 and 34. It will be appreciated that each of the carriages 70 has its pivotal connection 86 pivotally connected to the first continuous belt conveyor 36 and its pivotal connection 82 pivotally connected to the second continuous belt conveyor 56. Referring to FIG. 8, the carriages 70 also have stops 88 and 90 disposed at opposite ends of the top thereof.

From the foregoing, it should now be clear that a plurality of carriages 70 may advantageously be disposed intermediate the first continuous drive system 32 and the second continuous drive system 34. Of course, the exact number of carriages 70 will depend upon such factors as the length of the first and second continuous belt conveyors 36 and 56.

Referring to FIGS. 1 and 2, the signature transfer mechanism 22 comprises a first plow 92 having a signature receiving end 93 and a signature transferring end 94. The first plow 92 comprises first and second elongated inclined members 95 and 96 spaced apart at the top. The first and second members 95 and 96 are disposed at an angle such that when a signature rests thereon the leaves or pages of the lowermost folio are spread apart. The signature removal end 93 forms a point 98 for engaging the concealed underside of a signature from an upstream portion of the signature conveying system 24. As seen in FIG. 2, the plow 92 inclines downwardly from the signature receiving end 93 to the signature transferring end 94.

Still referring to FIG. 2, the signature transfer end 94 of the plow 92 cooperatively associates with the carriage 70 such that a signature propelled down the plow 92 may slide upon one of the carriages 70. The signature transfer mechanism 22 also includes a continuous propelling belt 100 disposed superjacent the plow 92. A first sprocket wheel 102 and a second sprocket wheel 104 form the continuous propelling belt 100 into a loop configuration. A plurality of dogs 114 are essentially uniformly spaced apart along the lateral extent of the continuous propelling belt 100. The dogs 114 are spaced apart such that they may engage the folded spine of signatures having varying lengths As shown in FIG. 1, the first and second members 95 and 96 of the first inclined plow 92 are spaced apart at the top such that the dogs 114 may pass therebetween at the top of the first plow 92.

Referring to FIGS. 1 and 2, the propelling belt 100 is driven by the line main drive 52 through the gear box 106 which is operatively associated with the continuous propelling belt 100. The operative association is accomplished through a drive shaft 108 which is concentrically connected to the second sprocket wheel 104 at one end and a sprocket 110 at its other end. As shown in FIG. 1, a continuous drive belt 112 drivingly interconnects the gear box 106 and the sprocket 110 for driven movement of the sprocket 110.

Figure 4:
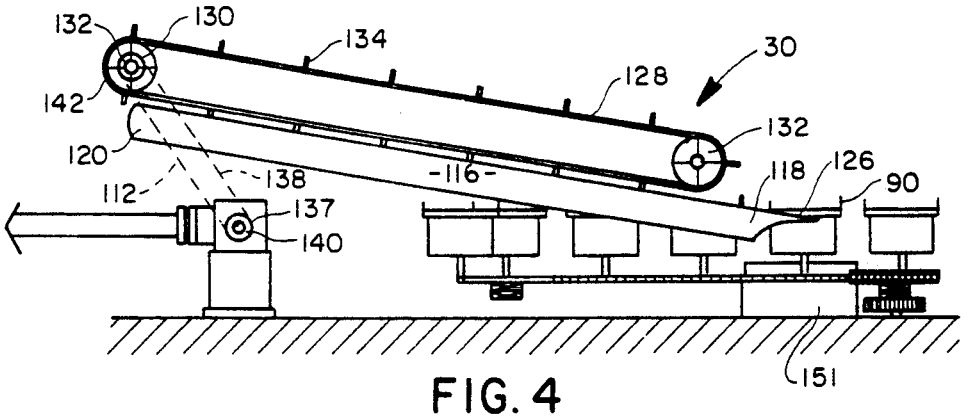
FIG. 4 is a cross-sectional view taken along line 4—4 of FIG. 1 showing a signature removal mechanism portion of the present invention.
Figure 5:
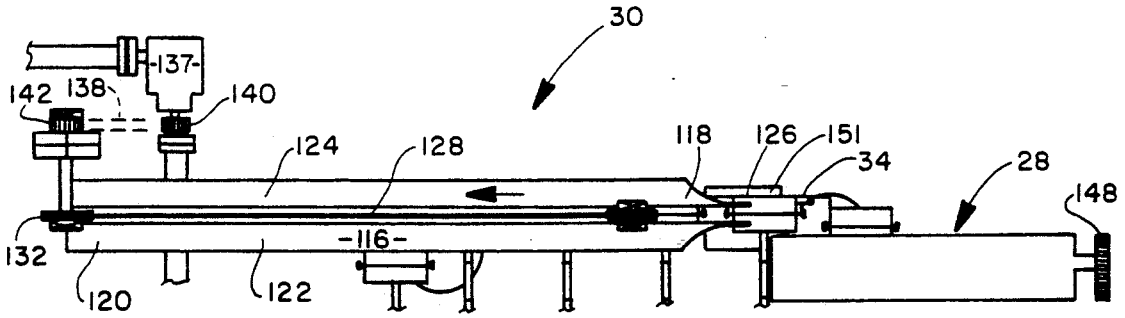
FIG. 5 is a top plan view of the signature removal portion of the present invention shown in FIG. 4.

Referring to FIG. 1, 4 and 5, the signature removal mechanism 30 comprises a second plow 116 having a signature removal end 118 and a signature transferring end 120. The second plow 116 comprises first and second elongated inclined members 122 and 124 spaced apart at the top. The first and second members 122 and 124 are disposed at an angle such that when a signature rests thereon the leaves or pages of the lowermost folio are spread apart. The signature removal end 118 forms a point 126 for engaging the concealed underside of a stitched signature conveyed by the carriage 70. As seen in FIG. 4, the plow 116 inclines upwardly from the signature removal end 118 to the signature transferring end 120.

Referring to FIGS. 4 and 5, the signature removal mechanism 30 includes a continuous propelling belt 128 disposed superjacent the plow 116. A first sprocket wheel 130 and a second sprocket wheel 132 form the continuous propelling belt 128 into a loop configuration. A plurality of dogs 134 are uniformly disposed along the lateral extent of the continuous propelling belt 128. The dogs 134 are spaced in a similar manner as the dogs 114 upon the continuous propelling belt 100. Referring to FIG. 1, the first and second members 122 and 124 of the second inclined plow 116 are spaced apart at the top such that the dogs 134 may pass therebetween at the top of the second plow 116.

As best shown in FIG. 4, the line main drive 52 is connected through the gear box 135 to a line secondary drive 136. The secondary line drive 136 is connected to a gear box 137. A drive belt 138 is connected between a sprocketed drive shaft 140 of the gear box 137 and a drive sprocket 142 concentrically attached to the second sprocket wheel 132. Now, also referring to FIGS. 1 and 9, the signature transfer end 120 of the second inclined plow 116 is cooperatively associated with the downstream portion of the signature conveying system 24 such that a signature propelled up the second inclined plow 116 may be passed to a downstream portion of the signature conveying system 24.

Referring specifically to FIG. 1, a rotary press stitcher 28 is disposed along the path of the carriage 70 as defined by the first continuous drive system 32 and the second continuous drive system 34. The rotary press stitcher 28 is controlled and driven by the line main drive 52 through the gear box 51. In this connection, it will be seen that a drive belt 144 extends between a sprocketed drive shaft 146 extending from the gear box 51 and a driving sprocket wheel 148 attached to the rotary press stitcher 28.

Figure 6A:
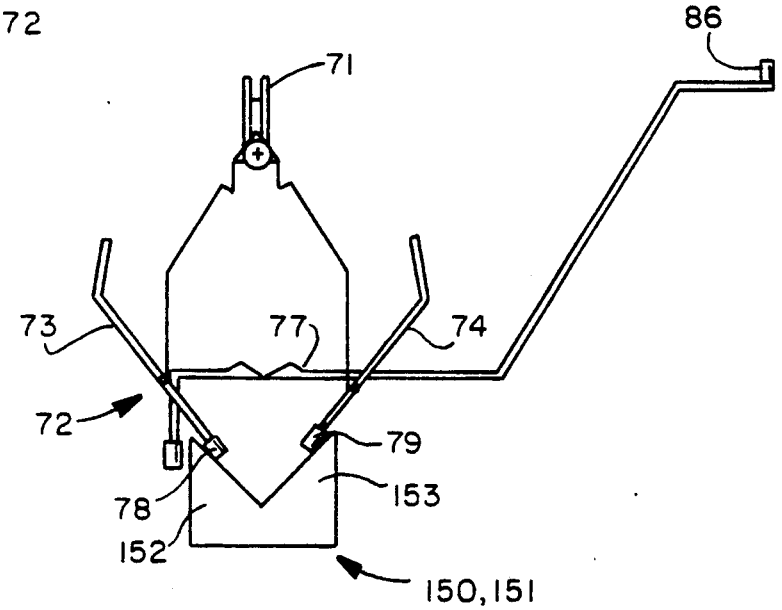
FIG. 6A is a front elevational view of a carriage portion of the present invention shown in FIG. 6 with the clamp arms in an unclamped position.

As seen in FIG. 2, a first cam actuator 150 for unclamping the clamp 70 is disposed just upstream and continues until just downstream of the signature transferring end 94 of the first inclined plow 92. As see in FIG. 4, a second cam actuator 151 for unclamping the clamp 70 is disposed just upstream and continues until just downstream of the removal end 118 of the second inclined plow 116. The first and second actuators 150, 151 are configured for engaging the cam followers 78, 79 and unclamping the clamp 70. The profile of the first and second cam actuators 150, 151 is best seen in FIG. 6A. A first actuating surface 152 engages the cam follower 78 and a second actuating surface 153 engages the cam follower 79.

Figure 9:
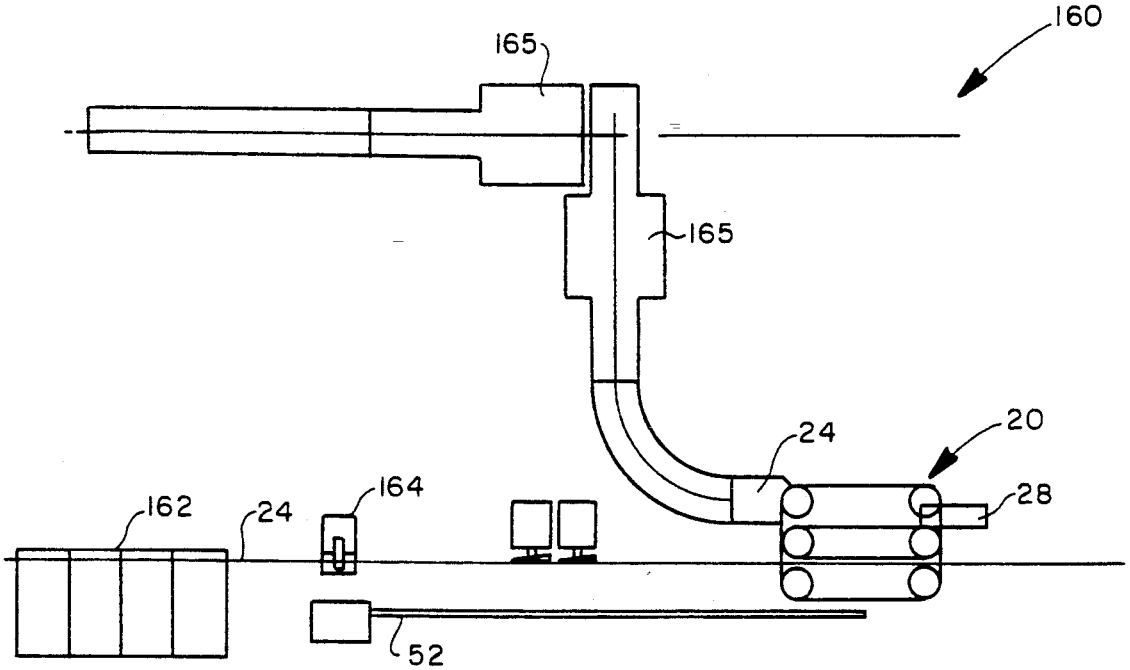
FIG. 9 is a schematic top plan view of a high speed bindery line utilizing the folded signature transfer and press stitcher delivery mechanism of the present invention.

The operation of the folded signature transfer and press stitcher delivery mechanism 20 of the present invention is best understood by first referring to FIG. 9.

As can be seen in FIG. 9, the folded signature transfer and press stitcher delivery mechanism 20 forms one element of a high speed bindery line layout 160. A signature assembly is formed when individual signatures are collated upon the gathering chain or signature conveying system 24 by the inserters 162. The signature assembly then passes through a caliper 164 which ensures that all the signatures comprising the complete signature assembly are present The signature assembly then is passed to the folded signature transfer and press stitcher delivery mechanism 20. The signature assembly is there passed through the rotary press stitcher 28 and then redeposited upon the signature conveying system 24. After this occurs, the signature assembly is then passed through trimmers 165 that cut the folded and stitched or stapled signature assembly to the appropriate size with finished edges at the fore edge, head and foot.

Figure 10:
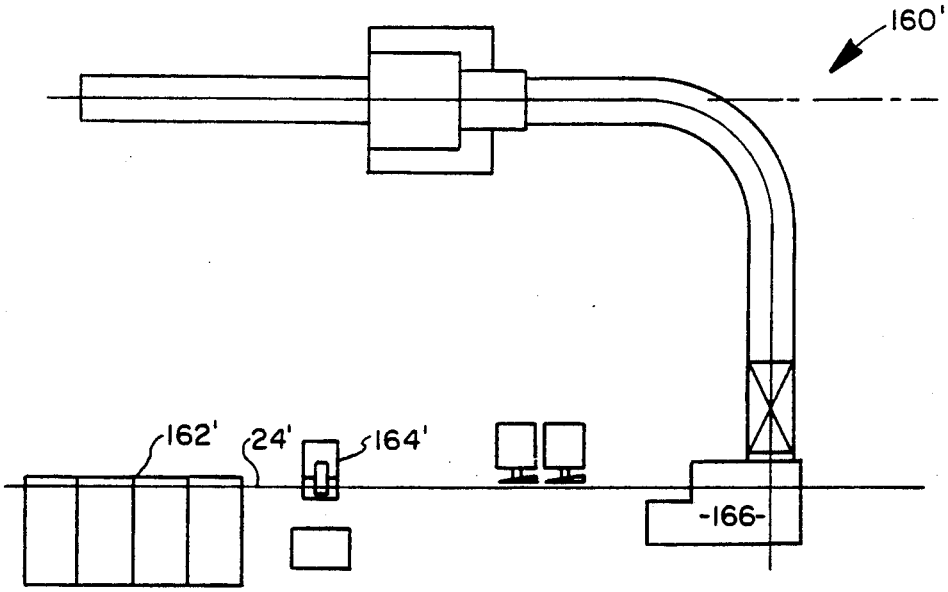
FIG. 10 is a schematic top plan view of a conventional bindery line utilizing a conventional stitcher.

The advantages of the high speed bindery line layout 160 are probably best understood when compared to a conventional bindery line layout 160' as illustrated in FIG. 10. In a conventional bindery line layout 160' a signature assembly is collated upon the gathering chain or signature conveying system 24' by a series of inserters 162'. The signature assembly then passes through a caliper 164' to assure the assembly is complete. The signature assembly then passes through a conventional lateral stitcher 166 disposed directly along the signature conveying system 24'. Because the conventional lateral stitcher 166 cannot operate as fast as the rotary press stitcher 28, this system results in the processing of fewer signature assemblies per hour. Thus, through the use of the folded signature and press stitcher delivery mechanism 20 the conventional binding line layout 160' may be modified to form a high speed binding line layout 160.

Figure 7:
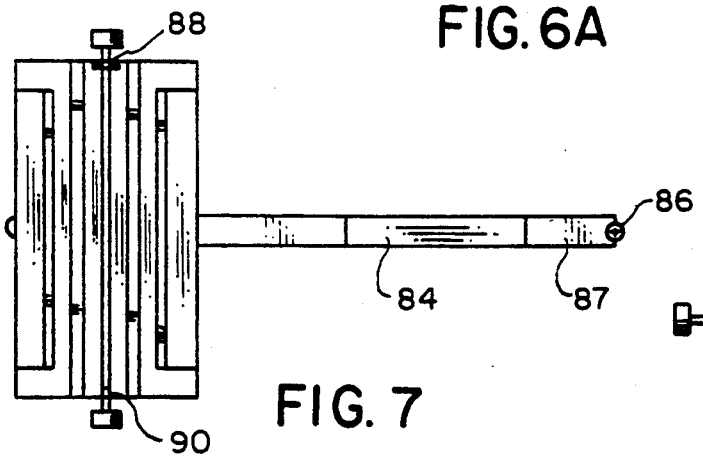
FIG. 7 is a top plan view of the carriage portion of the present invention shown in FIG. 6.

Referring to FIG. 2, the folded signature transfer and press stitcher delivery mechanism 20 functions as follows. A folded but unstitched signature assembly which is propelled along the signature conveying system 24 meets the tip 98 of the first plow 92 Due to the plow like configuration of the receiving end 93 of the first plow 92, the folded, unstitched signature assembly is driven upon the tip of the plow 98 until its concealed underside comes to rest upon the top of the first plow 92. The signature conveying system 24 passes between the first and second members 95 and 96 of the first plow 92 thus propelling the folded, unstitched signature assembly upon the signature receiving end 93 of the first plow 92 to a point where it can be engaged by a dog 114 disposed along the continuous propelling belt 100. The folded, unstitched signature assembly is then propelled down the first inclined plow 92 by the dog 114 attached to the continuous propelling belt 100 until it reaches the signature transfer end 94 of the first plow 92. At that point the folded, unstitched signature assembly is pushed by the dog 114 upon a carriage 70. Just upstream of the signature transfer end 94 of the first plow 92 the carriage 70 engages the first cam actuator 150. As best seen in FIG. 6A, the first and second actuating surfaces 152, 153 engage the cam followers 78, 79, forcing the cam followers together and causing the clamp arms 73, 74 to pivot away from the inverted "V" of the carriage 70. As the carriage 70 passes down stream of the signature transfer end 94 of the first plow 92 the first cam actuator 150 ends and the clamp arms 73, 74 clamp against the body of the inverted "V" by action of the spring 77, returning to the normal clamped position. As will be appreciated from the discussion hereinabove, the folded, unstitched signature assembly is held upon the carriage 70 by the stops 88 and 90 and the clamp 72 as best seen in FIGS. 7 and 8.

The carriage 70 maintains the same orientation as it moves about a generally rectangular path defined by the first continuous drive system 32 and the second continuous drive system 34 by virtue of the lateral offset of the first and second continuous drive systems 32 and 34.

More particularly, the carriage 70 is maintained in an orientation such that when it passes under the signature transfer end 94 of the first plow 92, the top of the carriage 70 is aligned with and moving in the vertical plane of the first plow 92 and the fold or spine of the folded, unstitched signature assembly By virtue of this alignment and movement, the folded, unstitched signature assembly is transferred to the first carriage 70 from the signature transfer end 96 of the first plow 92 with a component of velocity generally parallel to and in to the direction of travel of the carriage 70. As will be appreciated, this parallel velocity component permits the folded, unstitched signature assembly to be transferred to the carriage 70 smoothly with a minimal amount of jostling and misaligning of the individual signatures of the assembly.

As the carriage 70 moves around the generally rectangular path defined by the first and second continuous drive systems 32 and 34 it maintains a constant orientation. Thus, after it is conveyed by first and second continuous belt conveyors 36 and 56 away from the signature transfer end 94 of the first plow 92 and around the sprocketed driving wheels 44 and 62, the carriage 70 is still aligned with the top of the carriage 70 and, thus, the signature assembly fold is perpendicular to the direction of travel of the carriage 70 so that while thus aligned, the carriage 70 bearing the folded, unstitched signature assembly may pass directly under the rotary stitcher 28 Because the signature assembly fold is aligned perpendicular to the direction of travel, the rotary stitcher 28 is able to stitch the assembly "on the fly".

Following stitching, the carriage 70 bearing the stitched signature assembly continues along the generally rectangular path defined by the first and second continuous drive systems 32 and 34. When the first and second continuous belt conveyors 36 and 56 have passed around the sprocketed idler wheels 60 and 42, the top of the carriage 70 again moves in a direction parallel to the signature assembly fold. In this manner the carriage 70 remains aligned parallel but spread from the vertical plane of the first plow 92 where it is positioned within the vertical plane of the second plow 116. Just upstream of the signature removing end 118 of the second plow 116 the carriage 70 engages the second cam actuator 151. As best seen in FIG. 6A, the first and second actuating surfaces 152, 153 engage the cam followers 78, 79, forcing the cam followers together and causing the clamp arms 73, 74 to pivot away from the inverted "V" of the carriage 70. When the second cam actuator 151 ends, the clamp arms 73, 74 return to their normally clamped position.

As best illustrated in FIG. 4, while the carriage 70 is oriented within the vertical plane of the second plow 116 it passes through the gap formed by the first and second members 122 and 124 of the second inclined plow 116 and the point 126 of the signature removing end 118 of the second plow 116 engages the concealed underside of the folded, stitched signature assembly. When this occurs, the underside of the signature assembly fold rests along the top of the second plow 116 with the leaves or pages of the folios of the stitched signature assembly draped over the first and second members 122 and 124 thereof. As will be appreciated, the stop 90 of the carriage 70 pushes the signature assembly up the second inclined plow 116 to the point where a dog 134 can engage it for movement on the second plow 116.

More specifically, the continuous propelling belt 128 then pushes the stitched signature assembly up the second plow 116 through the action of the dog 134. When the stitched signature assembly reaches the signature transfer end 120 of the second plow 116 the signature transfer end 120 is cooperatively associated with the downstream portion of the signature conveying system 24 such that the folded signature assembly is deposited upon the signature conveying system 24. Once this has occurred, the stitched signature assembly may be moved by the downstream portion of he signature conveying system 24 for further processing.

As the carriage 70 passes downstream of the signature removing end 118 of the second plow 116 the second cam actuator 151 ends and the clamp arms 73, 74 clamp against the body of the inverted "V" by action of the spring 77, thus returning the carriage 70 to the normally clamped position.

As will be readily appreciated from the above description of the operation of the folded signature transfer and press stitcher delivery mechanism 20, the line main drive 52 is a controller which facilitates driving the first and second continuous belt conveyors 36 and 54 at a synchronized rate (e.g. the same speed) with respect to the upstream portion of the signature conveying system 24 to avoid an accumulation of signature assemblies at the signature removal end 93 of the first inclined plow 92. Similarly, the line main drive 52 facilitates driving the first and second continuous chain conveyors 36 and 56 at a synchronized rate with respect to the first continuous propelling belt 100 and the second continuous propelling belt 128. The downstream portion of the signature conveying system 24 is also driven at a synchronized rate with respect to the other components of the press stitcher delivery mechanism 20 by the line main drive 52 to avoid an accumulation of signature assemblies at the signature transferring end 120 of the second inclined plow 116. It should also be noted that the line main drive 52 similarly synchronizes the rotary press stitcher 28.

Because the folded signature transfer and press stitcher delivery mechanism 20 is able to feed properly oriented signature assemblies to a rotary press stitcher 28, the high speed bindery line layout 160 is able to process significantly more signatures per hour than a conventional binding line layout 160'. In addition, because of the fixed orientation of the carriage 70 as it moves about the path defined by the first and second continuous drive systems 32 and 34, the folded, unstitched signature assemblies are less likely to be jostled or otherwise disturbed such that the signatures become misaligned prior to passing under the rotary press stitcher 28. Moreover, because the carriages 70 receive the signature assemblies from the continuous propelling belt 100 and the first inclined plow 92 with a component of velocity parallel to the direction of the carriages 70, and because the carriage 70 delivers the signature assemblies to the second inclined plow 116 with a component of velocity parallel to the direction of movement of the continuous propelling belt 128 and to the second inclined plow 116, the signature assemblies are smoothly transferred, further reducing the likelihood of signature misalignment.

While in the foregoing there has been set forth a preferred embodiment of the invention, it will be appreciated that the details herein given may be varied by those skilled in the art without departing from the true spirit and scope of the appended claims.

I claim:

1. A press stitcher delivery mechanism for conveying properly aligned and folded signatures to a press stitcher, comprising:

first and second continuous drive systems, the second continuous drive system being disposed in a plane parallel and subjacent to the plane formed by the first continuous drive system, the second continuous drive system being laterally offset from the first continuous drive system;

means driving the first and second continuous drive systems in the same direction at substantially the same velocity;

a carriage disposed intermediate the first and second continuous drive systems for carrying a signature thereon;

means interconnecting the carriage to the first and second continuous drive systems for driven movement in a closed path defined thereby; and means for maintaining the carriage in a preselected, unchanging orientation as the carriage is driven about the closed path; and the press stitcher being disposed along the closed path about which the carriage is driven for stitching the signature carried thereon.

2. The press stitcher delivery mechanism of claim 1 wherein the first and second continuous drive systems define identical configurations.

3. The press stitcher delivery mechanism of claim 1 wherein the carriage has a profile resembling an inverted V. with the apex comprising the top of the carriage.

4. The press stitcher delivery mechanism of claim 1 wherein the interconnecting means comprises a first rod extending from and rigidly connected to the carriage at its proximal end, its distal end being pivotably associated with the first continuous drive system, a second rod extending from and rigidly connected to the carriage at its proximal end, its distal end being pivotably associated with the second continuous drive system, whereby the carriage is movable in a defined path relative to the continuous drive systems.

5. The press stitcher delivery mechanism of claim 1 wherein the press stitcher is disposed along the closed path of the carriage at a point where the carriage is disposed perpendicular to the direction of travel of the carriage.

6. The press stitcher delivery mechanism of claim 1 wherein the press stitcher is a rotary press stitcher.

7. The press stitcher delivery mechanism of claim 1 further including means for releasably clamping the signature carried on the carriage in place.

8. A press stitcher delivery mechanism for conveying properly aligned signatures to a rotary press stitcher comprising:

first and second continuous drive systems, the second continuous drive system being disposed in a plane parallel and subjacent to the plane formed by the first continuous drive system, the second continuous drive system being laterally offset from the first continuous drive system;

means driving the first and second continuous drive systems in the same direction at substantially the same velocity;

a carriage disposed intermediate the first and second continuous drive systems for carrying a signature thereon; and means for interconnecting the carriage to the first and second continuous drive systems and for maintaining the carriage in the same orientation, the interconnecting means comprising a first rod extending from and rigidly connected to the carriage at its proximal end, its distal end being pivotably associated with the first continuous drive system and a second rod extending from and rigidly connected to the carriage at its proximal end, its distal end being pivotably associated with the second continuous drive system, whereby the carriage is movable in a defined path relative to the continuous drive systems and in the same orientation upon being driven by the continuous drive systems;

the rotary press stitcher being disposed along the closed path about which the carriage is driven for stitching the signature carried thereon.

9. The press stitcher delivery mechanism of claim 8 wherein the rotary press stitcher is disposed along the closed path of the carriage at a point where the carriage is perpendicular to the direction of travel of the carriage.

10. The press stitcher delivery mechanism of claim 8 wherein the carriage has a profile resembling an inverted V with the apex comprising the top of the carriage.

11. The press stitcher delivery mechanism of claim 8 wherein the first and second continuous drive systems define identical configurations.

12. The press stitcher delivery mechanism of claim 8 further including means for releasably clamping the signature carried on the carriage in place.

13. A signature transfer mechanism for receiving folded signatures draped over a signature conveying system, comprising:

an elongated inclined plow, the plow being cooperatively associated with the signature conveying system for slidably receiving folded signatures therefrom;

continuous propelling means disposed adjacent the inclined plow, the continuous propelling means having means associated therewith for pushing the folded signatures along the inclined plow; and means controlling the continuous propelling means such that the continuous propelling means travels at substantially the speed as the signature conveying system.

14. The signature transfer mechanism of claim 13 wherein the pushing means comprises a plurality of spaced apart dogs substantially uniformly disposed along the lateral extent of the continuous propelling means.

15. A folded signature transfer and press stitcher delivery mechanism for receiving folded signatures draped over a signature conveying system, delivering the folded signatures to a press stitcher and returning the folded and stitched signatures to the signature conveying system, comprising:

a first elongated inclined plow, the plow being cooperatively associated with the signature conveying system for slidably receiving folded signatures therefrom;

a first continuous propelling means disposed adjacent to the first inclined plow, the first continuous propelling means having means associated therewith for pushing the folded signatures along the first inclined plow;

a carriage cooperatively associated with the first plow for slidably receiving folded signatures therefrom;

first and second continuous drive systems, the second continuous drive system being disposed in a plane parallel and subjacent to the plane formed by the first continuous drive system, the second continuous drive system being laterally offset from the first continuous drive system;

the carriage being disposed intermediate the first and second continuous drive systems;

means interconnecting the carriage to the first and second continuous drive systems for driven movement in a closed path defined thereby;

means for maintaining the carriage in a preselected, unchanging orientation as the carriage is driven about the closed path;

the press stitcher being disposed along the closed path of the carriage for stitching the signature carried thereon;

a second inclined plow disposed along the closed path of the carriage downstream from the first plow and the press stitcher for slidably receiving the folded, stitched signature from the carriage;

a second continuous propelling means disposed adjacent the second inclined plow, the second continuous propelling means having means associated therewith for pushing the folded, stitched signatures along the second inclined plow; and means driving the first and second continuous propelling means, the signature conveying system and the first and second continuous drive systems at substantially the same speed.

16. The folded signature transfer and press stitcher delivery mechanism of claim 15 wherein the pushing means associated with the first and second continuous propelling means comprises a plurality of spaced apart dogs substantially uniformly disposed along the lateral extent of the respective continuous propelling means.

17. The folded signature transfer and press stitcher delivery mechanism of claim 15 wherein the first and second continuous drive systems define identical configurations.

18. The folded signature transfer and press stitcher delivery mechanism of claim 15 wherein the carriage has a profile resembling an inverted V with the apex comprising the top of the carriage.

19. The folded signature transfer and press stitcher delivery mechanism of claim 15 wherein the interconnecting comprises a first rod extending from and rigidly connected to the carriage at its proximal end, its distal end being pivotably associated with the first continuous drive system, a second rod extending from and rigidly connected to the carriage at its proximal end, its distal end being pivotably associated with the second continuous drive system, whereby the carriage is movable in a defined path relative to the continuous drive systems.

20. The folded signature transfer and press stitcher delivery mechanism of claim 15 wherein the stitcher is disposed along the closed path of the carriage at a point where the carriage is oriented perpendicular to the direction of travel of the carriage.

21. The folded signature transfer and press stitcher delivery mechanism of claim 15 wherein the press stitcher is a rotary press stitcher.

22. The folded signature transfer and press stitcher delivery mechanism of claim 15 further including means for releasably clamping the signature carried on the carriage in place.

23. The folded signature transfer and press stitcher delivery mechanism of claim 22 further including first actuating means for causing the means for releasably clamping to be in an unclamped position slightly upstream and slightly downstream the first elongated inclined plow and means for causing the means for releasably clamping to be in an unclamped position slightly upstream and slightly downstream of the second elongated inclined plow.

24. A folded signature transfer and rotary press stitcher delivery mechanism for receiving folded signatures draped over a signature conveying system, delivering the folded signatures to a rotary press stitcher and returning the folded and stitched signatures to the signature conveying system, comprising:

a first elongated inclined plow, the plow being cooperatively associated with the signature conveying system for slidably receiving folded signatures from the conveying system;

a first continuous propelling means disposed adjacent to the first inclined plow, the first continuous propelling means having means associated therewith for pushing the folded signatures along the inclined plow;

at least one carriage cooperatively associated with the first plow for slidably receiving folded signatures therefrom;

first and second continuous drive systems, the second continuous drive system being disposed in a plane parallel and subjacent to the plane formed by the first continuous drive system, the second continuous drive system being laterally offset from the first continuous drive system;

the carriage being disposed intermediate the first and second continuous drive systems;

means for interconnecting the carriage to the first and second continuous drive systems and means for maintaining the carriage in the same orientation, the interconnecting means comprising a first rod extending from and rigidly connected to the carriage at its proximal end, its distal end being pivotably associated with the first continuous drive system and a second rod extending from and rigidly connected to the carriage at its proximal end, its distal end being pivotably associated with the second continuous drive system, whereby the carriage is movable in a defined path relative to the continuous drive systems and in the same orientation upon being driven by the continuous drive systems;

the rotary press stitcher being disposed along the closed path of the carriage for stitching the signature carried by carriage;

a second inclined plow disposed along the closed path of the carriage downstream from the first plow and the rotary stitcher, the second inclined plow being cooperatively associated with the carriage for slidably receiving the signature therefrom;

a second continuous propelling means disposed adjacent the second inclined plow, the second continuous propelling means having means associated therewith for pushing the folded signatures along the second inclined plow; and means driving the first and second continuous propelling means, the signature conveying system and the first and second continuous drive systems at substantially the same speed.

25. The folded signature transfer and rotary press stitcher delivery mechanism of claim 24 wherein the rotary stitcher is disposed along the closed path of the carriage at a point where the carriage is oriented perpendicular to the direction of travel of the carriage.

26. The folded signature transfer and rotary press stitcher delivery mechanism of claim 24 wherein the carriage has a profile resembling an inverted V with the apex comprising the top of the carriage.

27. The folded signature transfer and rotary press stitcher delivery mechanism of claim 24 wherein the first and second continuous drive systems define identical configurations.

28. The folded signature transfer and rotary press stitcher delivery mechanism of claim 24 wherein the pushing means associated with the first and second continuous propelling means comprise a plurality of spaced apart dogs substantially uniformly disposed upon the lateral extent of the respective continuous propelling means.

29. The folded signature transfer and press stitcher delivery mechanism of claim 24 further including means for releasably clamping the signature carried on the carriage in place.

30. The folded signature transfer and press stitcher delivery mechanism of claim 29 further including first actuating means for causing the means for releasably clamping to be in an unclamped position slightly upstream and slightly downstream the first elongated inclined plow and means for causing the means for releasably clamping to be in an unclamped position slightly upstream and slightly downstream of the second elongated inclined plow.

31. A method for stitching a folded signature in a signature conveying system, comprising:

transferring the signature from the signature conveying system to a first elongated inclined plow, the plow being cooperatively associated with the signature conveying system for slidably receiving folded signatures therefrom;

propelling the folded signature along the first inclined plow at a speed substantially the same as the speed of the signature conveying system;

slidably transferring the folded signature to a carriage;

driving the carriage about a continuous closed path in a preselected, unchanging orientation;

stitching the signature with a rotary press stitcher disposed downstream from the first inclined plow along the continuous closed path of the carriage;

transferring the folded, stitched signature to a second inclined plow disposed along the path of the carriage downstream from the first plow and the rotary press stitcher;

propelling the folded, stitched signature along the second inclined plow a speed substantially the same as the speed of the carriage; and transferring the folded, stitched signature back to the signature conveying system from the second inclined plow.

32. The method of claim 31 wherein the carriage is oriented with the signature perpendicular to the path of travel of the carriage when the signature is stitched by the rotary press stitcher.

33. The method of claim 32 further including clamping the folded signature to the carriage after the folded signature is transferred to the carriage and unclamping the folded signature before transferring it to the signature conveying system from the second inclined plow.

* * * * *